US010591854B1

(12) United States Patent
Arakawa

(10) Patent No.: US 10,591,854 B1
(45) Date of Patent: Mar. 17, 2020

(54) IMAGE FORMING APPARATUS CONFIGURED TO DETERMINE HEATER ELEMENTS TO BE ENERGIZED AND IMAGE FORMING METHOD PERFORMED THEREBY

(71) Applicant: TOSHIBA TEC KABUSHIKI KAISHA, Tokyo (JP)

(72) Inventor: Masaya Arakawa, Hiratsuka Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/209,821

(22) Filed: Dec. 4, 2018

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/5029* (2013.01); *G03G 15/2064* (2013.01)

(58) Field of Classification Search
CPC ..... G03G 15/2039; G03G 15/2053; G03G 15/5029; G03G 15/2064
See application file for complete search history.

(56) References Cited

U.S. PATENT DOCUMENTS

2016/0085188 A1* 3/2016 Takagi ..... G03G 15/2042 399/69
2018/0067428 A1 3/2018 Takagi

* cited by examiner

*Primary Examiner* — Sandra Brase
(74) *Attorney, Agent, or Firm* — Kim & Stewart LLP

(57) ABSTRACT

An image forming apparatus includes a plurality of heater elements arranged in a direction perpendicular to a sheet transport direction to heat the sheet, a plurality of temperature sensors, each of which is configured to detect a temperature of one of the heater elements, and a controller configured to control each of the sensors to detect a first temperature before the sheet is passed by the corresponding heater element and a second temperature of the heater element after the sheet is passed by the corresponding heater element, and determine one or more of the heater elements to be energized based on the first temperatures and the second temperatures detected by the sensors.

20 Claims, 10 Drawing Sheets

IMAGE FORMING APPARATUS CONFIGURED TO DETERMINE HEATER ELEMENTS TO BE ENERGIZED AND IMAGE FORMING METHOD PERFORMED THEREBY

FIELD

Embodiments described herein relate generally to an image forming apparatus and an image forming method.

BACKGROUND

In an image forming apparatus such as a multi-function peripheral (MFP), to press toner on a sheet or a document for printing, a fixing device including a single heater element or a plurality of heater elements is used. Since an MFP including a plurality of heater elements causes only the heater elements corresponding to the actual printing area on the sheet to generate heat, power consumption can be reduced relative to an MFP with a single heater element.

Some MFPs having a plurality of heater elements cause only a predetermined number of heater elements located on a transportation path of a sheet to generate heat. In such MFPs, printing may not be performed accurately when the sheet is not transported along the correct path due to an error in assembling components, an incorrect placement of the sheet by a user, degradation of the components over time, or an issue caused when the product is shipped.

DETAILED DESCRIPTION

An embodiment provides an image forming apparatus and an image forming method capable of determining position of heater elements caused to be energized (heating) in accordance with a transport path of a sheet.

According to one or more embodiments, an image forming apparatus comprises a plurality of heater elements arranged in a direction perpendicular to a sheet transport direction to heat the sheet; a plurality of temperature sensors, each of which is configured to detect a temperature of one of the heater elements; and a controller configured to: control each of the sensors to detect a first temperature before the sheet is passed by the corresponding heater element and a second temperature of the heater element after the sheet is passed by the corresponding heater element, and determine one or more of the heater elements to be energized based on the first temperatures and the second temperatures detected by the sensors.

Hereinafter, an image forming apparatus and an image forming method according to an embodiment will be described with reference to the drawings.

Figure 1:
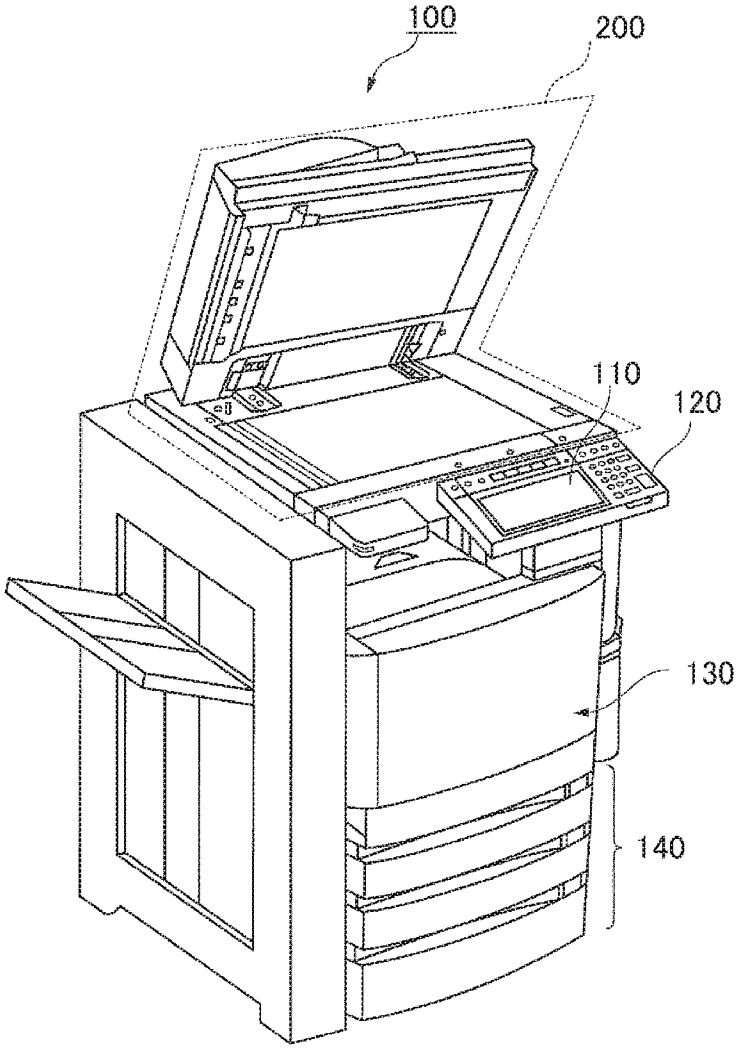
FIG. 1 is an exterior view of an image forming apparatus according to an embodiment.

FIG. 1 is an exterior view of an image forming apparatus 100 according to one or more embodiments. The image forming apparatus 100 is, for example, an MFP. The image forming apparatus 100 includes a display 110, a control panel 120, a printer 130, a sheet accommodation unit 140, and an image reading unit 200. The printer 130 of the image forming apparatus 100 is an electrophotographic apparatus that fixes a toner image.

The image forming apparatus 100 forms an image on a sheet using a developer such as toner. The sheet is, for example, a paper or a label paper. Any type of sheet may be used as long as the image forming apparatus 100 can form an image on a surface of the sheet.

The display 110 is an image display device such as a liquid crystal display or an electro-luminescence (EL) display. The display 110 displays various kinds of information regarding the image forming apparatus 100.

The control panel 120 includes a plurality of buttons. The control panel 120 receives an operation by a user. The control panel 120 outputs a signal in accordance with an operation performed by the user to a control unit of the image forming apparatus 100. The display 110 and the control panel 120 may be configured as an integrated touch panel.

The printer 130 forms an image on a sheet based on image information generated by the image reading unit 200 or image information received via a communication path. The printer 130 forms an image through, for example, the following process. An image forming unit of the printer 130 forms an electrostatic latent image on a photoconductive drum based on the image information. The image forming unit of the printer 130 forms a visible image by attaching a developer on the electrostatic latent image. An example of the developer is toner. A transfer unit of the printer 130 transfers the visible image to the sheet. A fixing device 50 of the printer 130 fixes the visible image on the sheet by heating and pressurizing the sheet. The sheet on which the image is formed may be a sheet accommodated in the sheet accommodation unit 140 or may be a sheet loaded by a hand. The fixing device 50 included in the printer 130 will be described using a specific example with reference to FIG. 2.

Figure 2:
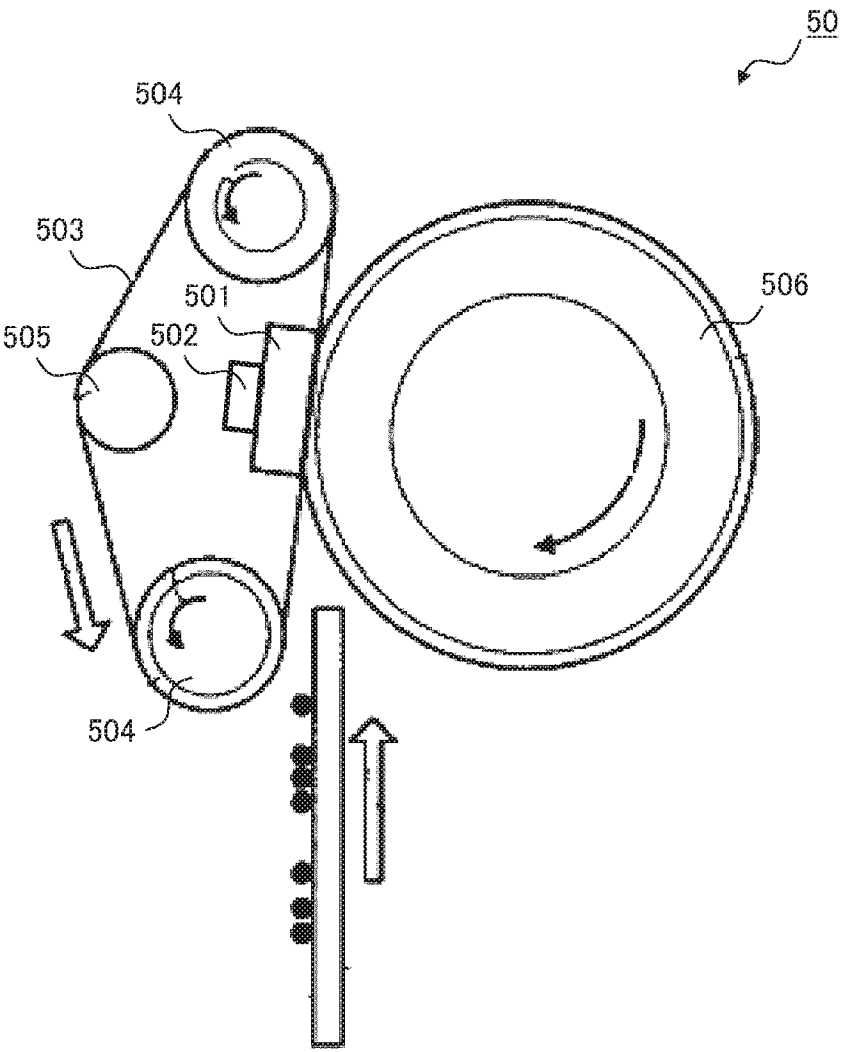
FIG. 2 is a schematic diagram of a fixing device included in a printer according to one or more embodiments.

FIG. 2 is a schematic diagram of the fixing device 50 according to one or more embodiments. Here, the fixing device 50 includes a flat-shaped heating member 501, a thermistor 502 (temperature sensor) that measures temperature of the heating member 501, an endless belt 503 that is suspended on a plurality of rollers, a belt transport roller 504 that drives the endless belt 503, a tension roller 505 that provides a tensile force to the endless belt 503, and a press roller 506 where an elastic layer is formed on its surface. A heating unit side of the heating member 501 comes into contact with the inside of the endless belt 503 to press the endless belt 503 in the direction of the press roller 506, and forms a fixing nip with a predetermined width with the press roller 506. In a configuration in which the heating member 501 heats a sheet via the endless belt 503 while forming a nip region, responsiveness at the time of energization is higher than in the case of a heating scheme by a halogen lamp.

The endless belt 503 is a film-shaped member. For example, a silicon rubber layer with a thickness of 200 μm is formed on a stainless steel base with a thickness of 50 μm or the outside of polyimide which is a heat-resistant resin of 70 μm. The outermost circumference of the endless belt 503 is coated with a surface protection layer such as perfluoroalkoxy (PFA). In the press roller 506, for example, a silicon sponge layer with a thickness of 5 mm is formed on the surface of an iron rod with ϕ 100 mm and the outer circumference is coated with a surface protection layer such as PFA.

In the heating member 501, a glaze layer and a heat generation resistant layer are stacked on a ceramic substrate. To prevent excessive heat dissipation to the opposite side and bending of a substrate, the heat generation resistant layer is formed of, for example, an existing material such as $TaSiO_2$ and is segmented into a predetermined number of pieces with a predetermined length in a main scanning direction (a longitudinal direction of the heating member 501). The individual segmented heat generation resistant layer is equivalent to a heater element H and generates heat by direct-current or alternating-current application voltage. The thermistor 502 is provided corresponding to each of the plurality of heater elements H and measures temperature corresponding to each heater element H.

A method of forming the heat generation resistant layer is similar to an existing method (for example, a method of generating a thermal head) and a masking layer is formed on the heat generation resistant layer with aluminum. The adjacent heat generation resistant layers are insulated from each other and an aluminum layer is formed in a pattern in which the heat generation resistors (the heater elements H) are exposed in a sheet transport direction. For energization to the heat generation resistant layers, wirings are connected from aluminum layers (electrodes) at both ends and each heat generation resistant layer is connected to a switching element of a switching driver IC. Further, a protective layer is formed on an uppermost portion to cover all of the heat generation resistant layer, the aluminum layer, and the wrings. The protective layer is formed by, for example, $Si_3N_4$.

In an embodiment, a scheme of fixing a developer image to a sheet by heating the developer image via a film-shaped member in the fixing device 50 is applied in the description.

Referring back to FIG. 1, the description will be made. The sheet accommodation unit 140 accommodates sheets to be used to form images in the printer 130.

The image reading unit 200 reads reading target image information as brightness of light. The image reading unit 200 records the read image information. The recorded image information may be transmitted to another information processing device via a network. An image of the recorded image information may be formed on a sheet by the printer 130. The image reading unit 200 may include an automatic document feeder (ADF).

Figure 3:
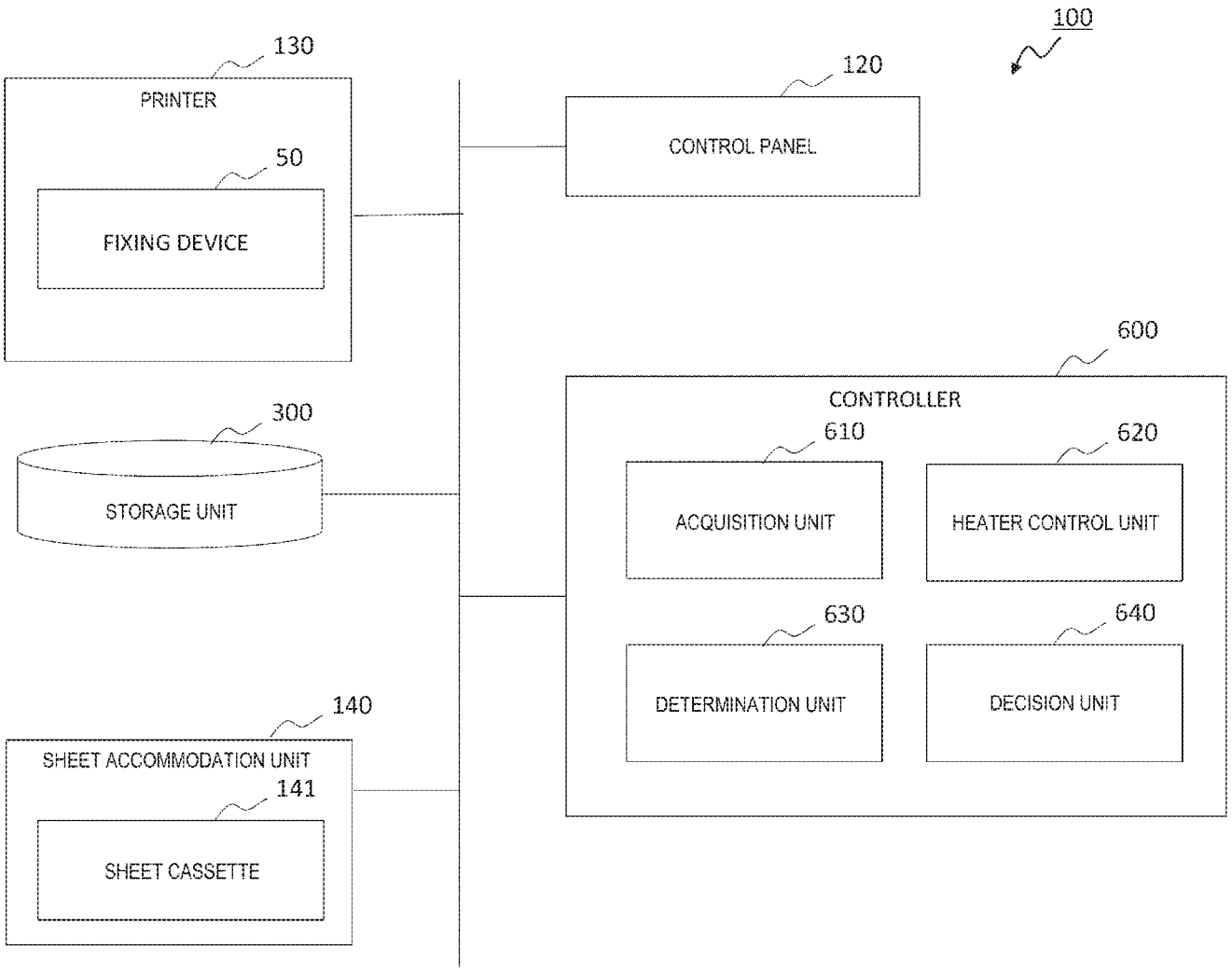
FIG. 3 is a block diagram illustrating functions of the image forming apparatus according to one or more embodiments.

FIG. 3 is a block diagram illustrating functions of the image forming apparatus 100 according to one or more embodiments. The image forming apparatus 100 includes a control panel 120, a printer 130, a sheet accommodation unit 140, a storage unit or a memory 300, and a controller 600. The control panel 120 and the printer 130 described with reference to FIGS. 1 and 2 will not be described.

The sheet accommodation unit 140 includes a sheet cassette 141 that accommodates sheets with various sizes and an input tray. The sheet accommodation unit 140 may include the plurality of sheet cassettes 141 or one sheet cassette 141.

The storage unit 300 includes a storage device such as a magnetic hard disc device or a semiconductor storage device. The storage unit 300 stores information about a predetermined condition and image data to be printed. The predetermined condition is related to energization and non-energization of the plurality of heater elements H. Specific description of the predetermined condition will be made with reference to the drawings subsequent to FIG. 4. The storage unit 300 stores a program for setting a mode of an operation performed by the image forming apparatus 100 (hereinafter referred to as an "operation mode") in advance. The storage unit 300 may store information other than the foregoing information.

The controller 600 has a processor such as a central processing unit (CPU). When the processor executes a program, the controller 600 performs as an acquisition unit 610, a heater control unit 620, a determination unit 630, and a decision unit 640. Alternatively, the controller 600 may include dedicated circuits that operate as the above units 610-640. The controller 600 functions as the functional unit described above when positions at which the heater elements H are caused to be energized (hereinafter referred to as an "energization position") are adjusted. The adjustment is a process of determining positions at which the sheet passes through the heater element H and deciding the energization positions of the heater elements H used when a printing is performed.

The acquisition unit 610 obtains temperature information indicating a surface temperature of the heating member 501 corresponding to each heater element H from the thermistor 502. The acquisition unit 610 sends the obtained temperature information to the determination unit 630.

The heater control unit 620 controls the heater elements H. The heater control unit 620 controls the heater elements H based on a decision result of the decision unit 640. For example, the heater control unit 620 causes all the heater elements H to be energized to generate heat when the sheet is passed. For example, the heater control unit 620 causes the heater elements H decided as energization spots by the decision unit 640 to be energized (heating). For example, the heater control unit 620 reads the energization positions from the storage unit 300 and causes the heater elements H to be energized (heating).

The determination unit 630 receives the temperature information before sheet-conveyance and the temperature information during sheet-passing from the acquisition unit 610, and determines whether the temperature information corresponding to each heater element H is lower than a predetermined threshold. For example, when the heater elements H generate heat at a position where the sheet passes, the surface temperature of the heater elements H or the heating member 501 corresponding to the heater elements H is lowered since the heat is absorbed by the sheet. When the heater elements H generate heat at a position through which the sheet does not pass, the surface temperature of the heater elements H or the heating member 501 corresponding to the heater elements H is maintained or raised without absorbing the heat in the sheet.

Therefore, the heater control unit 620 causes all the heater elements H to be energized (heating) that are arranged in the main scanning direction (a direction perpendicular to the sheet transport direction). The acquisition unit 610 obtains the temperature information when all the heater elements H are caused to be energized (heating) and the sheet is passed. When the temperature corresponding to the heater elements H is lower than the predetermined threshold, the determination unit 630 determines that the sheet has passed the positions of the heater elements H. When the temperature corresponding to the heater elements H is not lower than the predetermined threshold, the determination unit 630 determines that the sheet has not passed the positions of the heater elements H. An example of a determination method by the determination unit 630 will be described with reference to FIG. 7.

The decision unit 640 decides whether to cause the heater elements H to be energized based on a determination result of the determination unit 630. The decision unit 640 decides the heater elements H to be energized (heating) in response to the sheet, that is, the sheet cassette 141, and saves information of energization position corresponding to the sheet cassette 141 in the storage unit 300.

Figure 4:
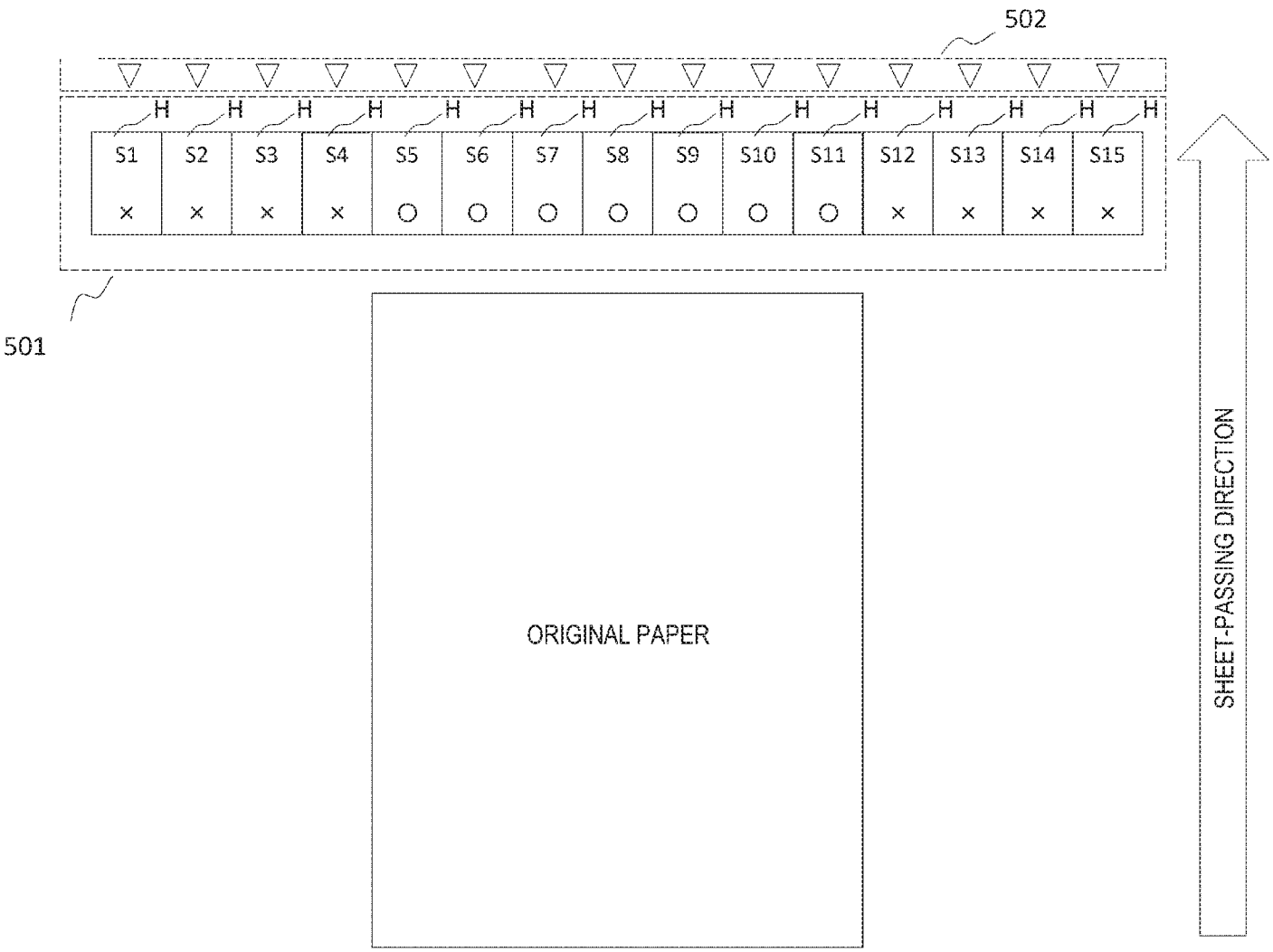
FIG. 4 is a diagram illustrating an arrangement of heater elements and a sheet to be transported according to one or more embodiments.

FIG. 4 is a diagram illustrating an arrangement of heater elements H and a sheet to be transported according to one or more embodiments. In FIG. 4, a spot indicated as x represents a non-energization state. In FIG. 4, a spot indicated as O represents an energization state.

For example, a case in which there are 15 heater elements H will be described as a specific example in FIG. 4. The sheet-passing direction is a direction in which the sheet is transported. The heater elements H are arranged in the main scanning direction and the positions of the heater elements H are denoted by S1 to S15. The thermistor 502 is arranged at the opposite side of the sheet with respect to the heating member 501 so that the thermistor 502 can detect a temperature of each heater element H of the heating member 501. In FIG. 4, energization positions determined in advance are S5 to S11. Therefore, in the example of FIG. 4, the positions (S5 to S11) where the sheet passes and the energization positions (S5 to S11) are the same positions. Therefore, the sheet passes through positions where the heater elements H are energized as sheet-passing positions.

Figure 5:
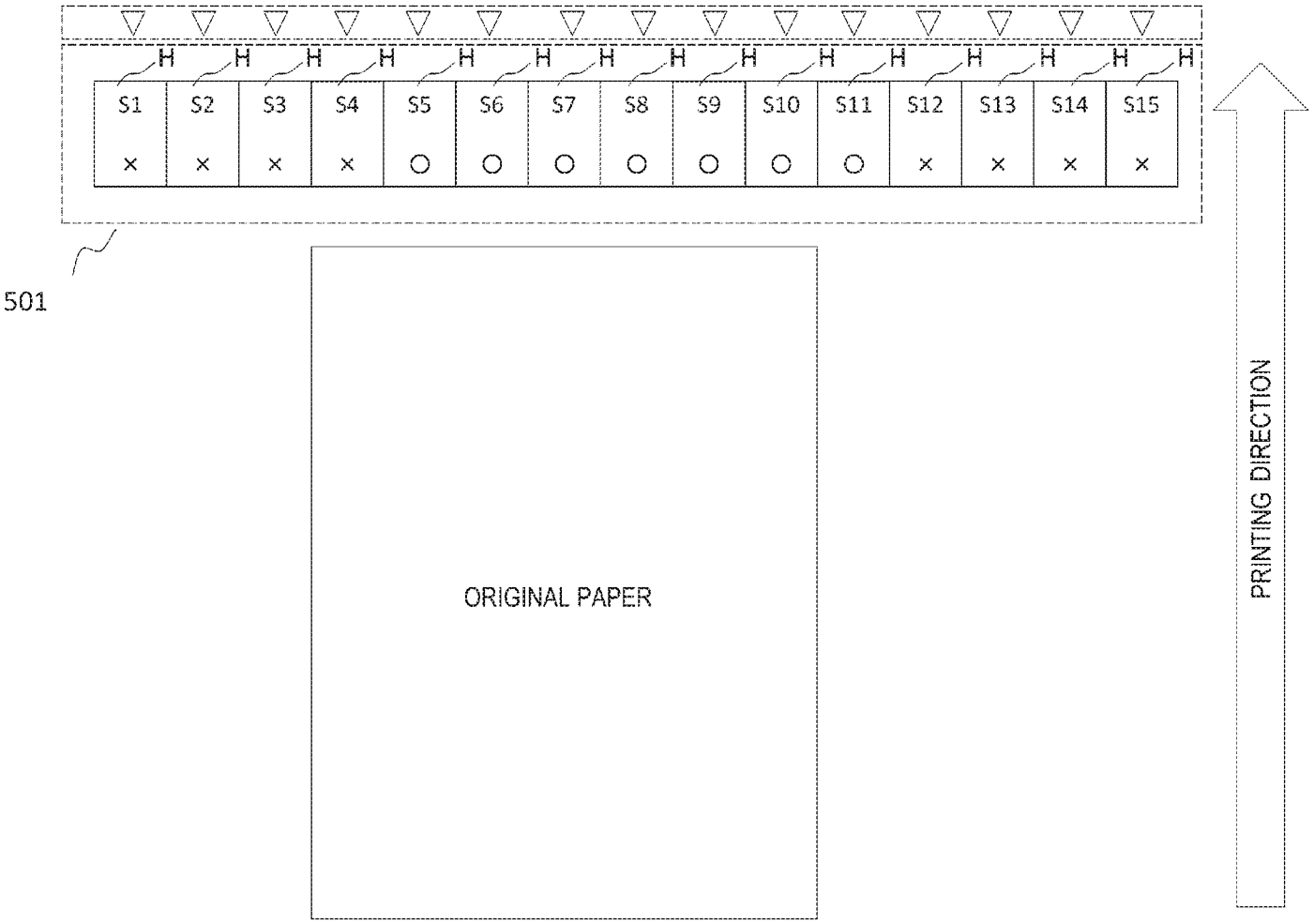
FIG. 5 is a diagram illustrating an arrangement of heater elements and a sheet to be transported from a different position according to one or more embodiments.

FIG. 5 is a diagram illustrating an arrangement of heater elements H and a sheet to be transported from a different position according to one or more embodiments. The description of the content described in FIG. 4 will not be repeated.

In FIG. 5, energization positions determined in advance at the time of shipment are S5 to S11. However, positions where the sheet passes are S4 to S10. Position deviation occurs between the positions (S4 to S10) where the sheet passes and the positions (S5 to S11). Therefore, when printing is performed along the sheet passage through S4, normal fixing may not be performed. Since the sheet does not pass through S11 which is an energization position, power is unnecessarily consumed. A method of adjusting the energization positions will be described with reference to FIGS. 6 and 7.

Figure 6:
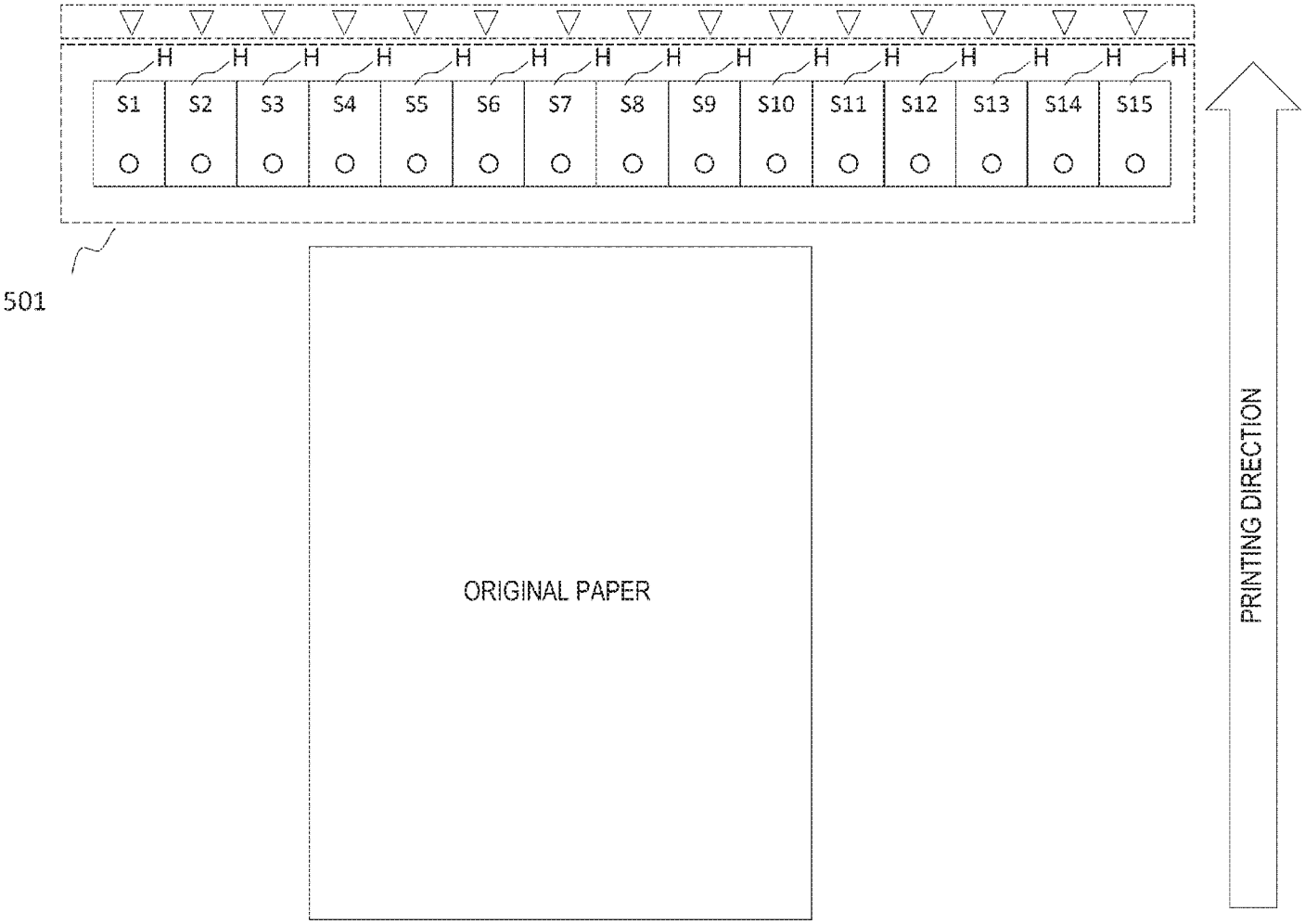
FIG. 6 is a diagram illustrating adjustment of a sheet-passing position according to one or more embodiments.

FIG. 6 is a diagram illustrating adjustment of a sheet-passing position according to an embodiment. The description of the content described in FIGS. 4 and 5 will not be repeated.

In FIG. 6, for example, since the deviation between the transport positions of the sheet and the energization positions is adjusted, the heater control unit 620 causes all the heater elements H arranged in the main scanning direction to be energized. At this time, the energization positions are S1 to S15. Adjusting the deviation will be described with reference to FIG. 7.

Figure 7:
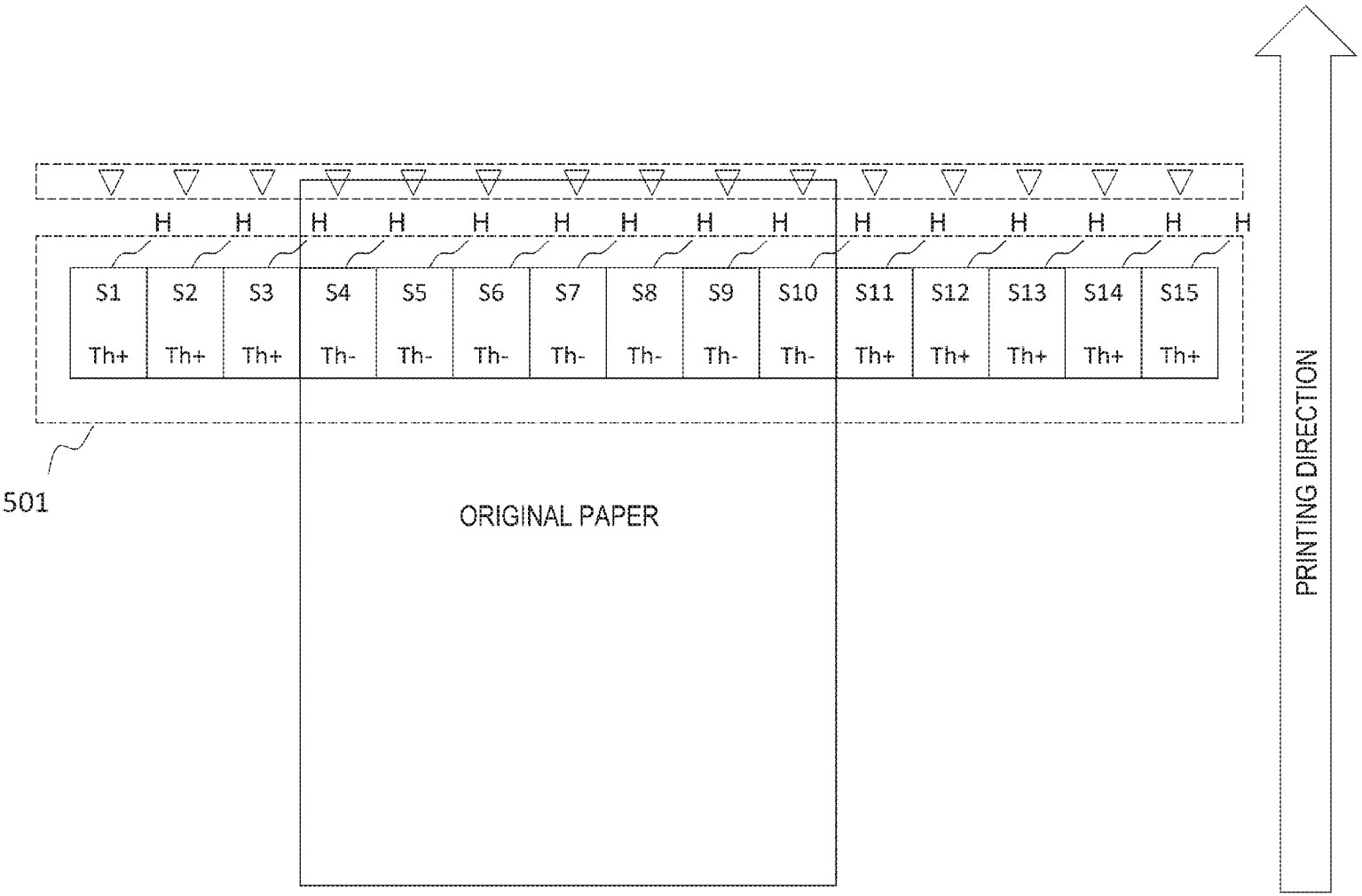
FIG. 7 is a diagram illustrating a temperature change corresponding to each heater element according to one or more embodiments.

FIG. 7 is a diagram illustrating a temperature change corresponding to each heater element H according to one or more embodiments. The description of the content described in FIGS. 4 to 6 will not be repeated.

In FIG. 7, the transport positions of the sheet and the energization positions are determined based on a temperature change when the sheet passes the heater elements H. The acquisition unit 610 obtains the temperature information of S1 to S15 while the sheet is passing. At this time, when the temperature of the heater elements H is lowered than a predetermined threshold, the determination unit 630 determines that the sheet has passed through the positions of the heater elements H. When the temperature of the heater elements H is not lowered than the predetermined threshold, the determination unit 630 determines that the sheet has not passed through the positions of the heater elements H.

In FIG. 7, a spot indicated as Th− is a spot where the temperature is lower than the predetermined threshold. A spot indicated as Th+ is a spot where the temperature is not lower than the predetermined threshold. For example, the determination unit 630 determines that the temperature corresponding to the heater elements H in S4 to S10 is lower than the predetermined threshold. In S1 to S3 and S11 to S15, the determination unit 630 determines that the temperature corresponding to the heater elements H is not lower than the predetermined threshold. Based on a determination result, the decision unit 640 determines S4 to S10 as the energization positions with respect to the sheet, that is, the sheet cassette 141.

Figure 8:
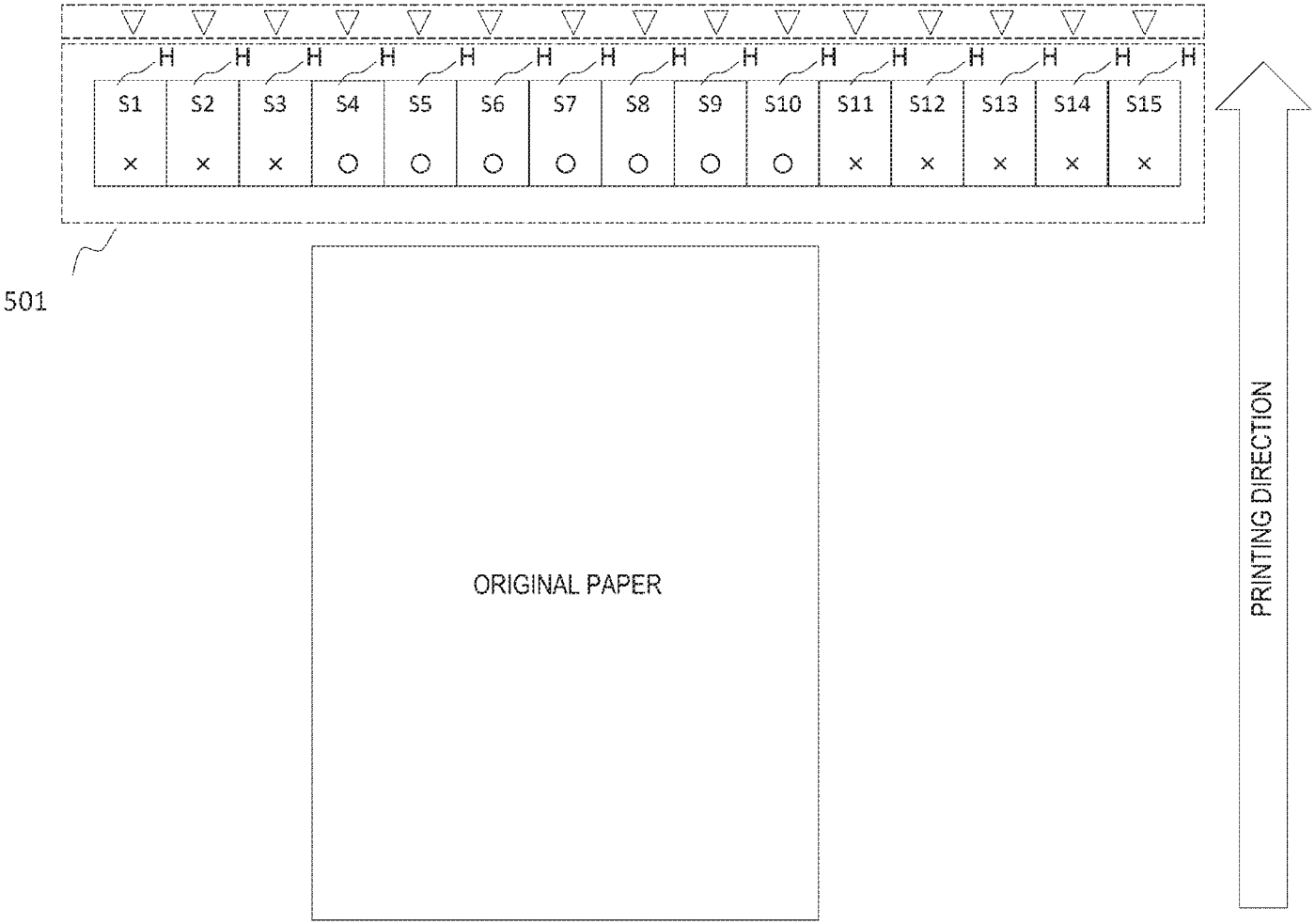
FIG. 8 is a diagram illustrating energization positions of the heater elements after the sheet-passing position is adjusted according to one or more embodiments.

FIG. 8 is a diagram illustrating energization positions of the heater elements H after the sheet-passing position is adjusted according to one or more embodiments. The description of the content described in FIGS. 4 to 7 will not be repeated.

In FIG. 8, the energization positions are changed from the energization positions (S5 to S11) determined in advance to the energization positions (S4 to S10) after the adjustment. Thus, in printing in which the sheet cassette 141 is used after the adjustment of the energization positions, energization (heating) is performed only at the energization positions (S4 to S10) after the adjustment. Even when printing is performed along the sheet passage through S4, normal fixing can be performed. The sheet has not passed through S11 which is the energization position. However, since the heater element H is turned off, power is not wastefully consumed.

Figure 9:
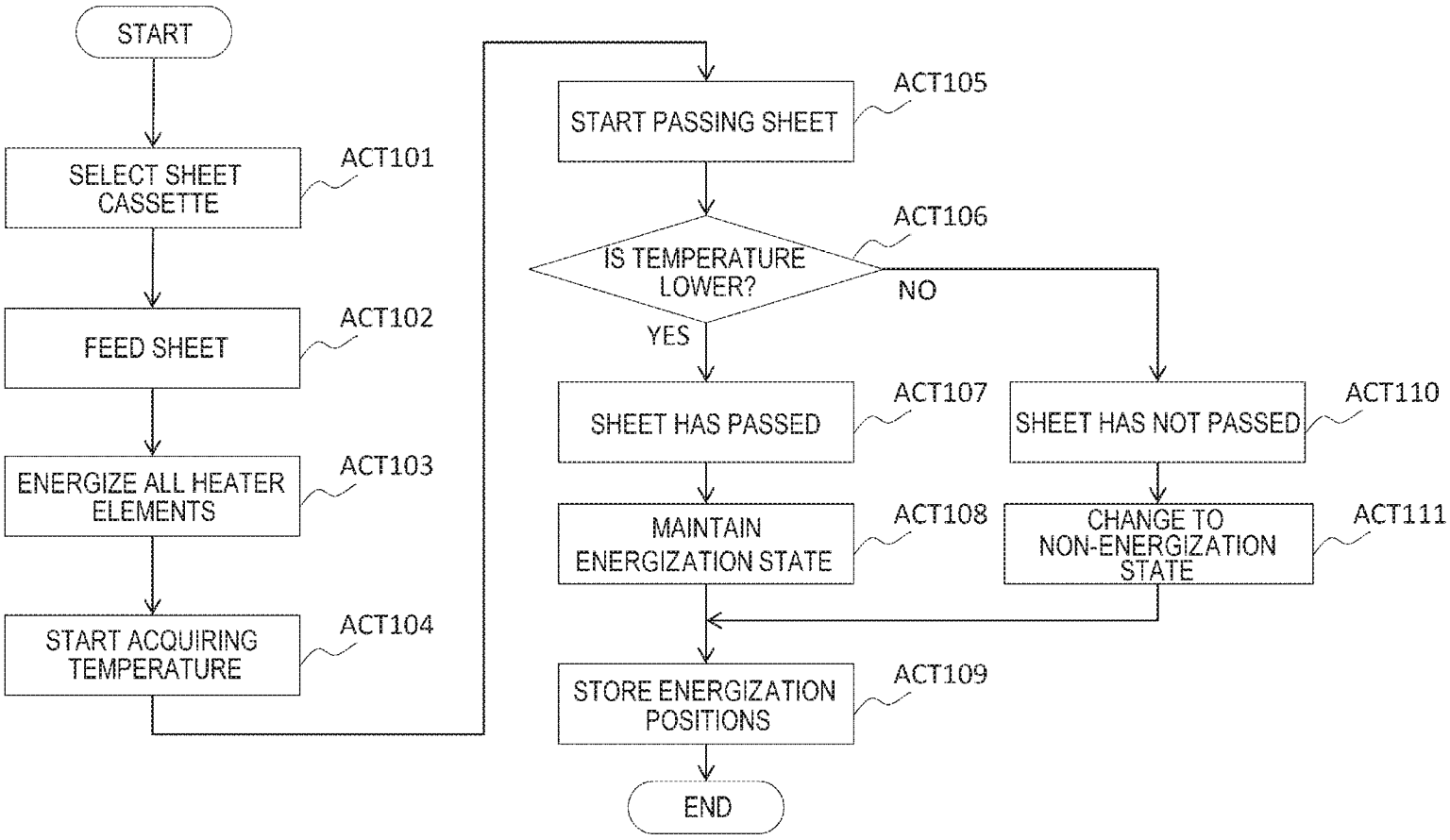
FIG. 9 is a flowchart illustrating a flow of adjusting the sheet-passing position according to one or more embodiments.

FIG. 9 is a flowchart illustrating a flow of adjusting the sheet-passing position according to one or more embodiments.

The information processing apparatus 100 selects the sheet cassette 141 to be used for printing from one sheet cassette 141 or the plurality of sheet cassettes 141 equipped in the sheet accommodation unit 140 (ACT 101). The information processing apparatus 100 feeds a sheet to the selected sheet cassette 141 (ACT 102) and starts adjusting the energization positions.

The heater control unit 620 causes all the heater elements H to be energized to generate heat (ACT 103). The acquisition unit 610 starts acquiring the temperature information corresponding to each heater element H (ACT 104).

Since the positions at which the heater elements H are energized are adjusted in the image forming apparatus 100, the sheet starts to be passed to the fixing device 50 (ACT 105). The determination unit 630 receives the temperature information before the sheet-passing and the temperature information during the sheet-passing from the acquisition unit 610 and determines whether the temperature corresponding to the heater elements H is lower than the predetermined threshold for each heater element H (ACT 106).

When the temperature corresponding to the heater elements H is lower than the predetermined threshold (YES in ACT 106), the determination unit 630 determines that the sheet has passed through the positions of the heater elements H (ACT 107). When it is determined that the sheet has passed through the positions of the heater elements H, the decision unit 640 decides the heater elements H as the energization positions with respect to the sheet, that is, the sheet cassette 141 (ACT 108). The decision unit 640 saves information regarding the sheet cassette 141 and the energization positions in the storage unit 300 (ACT 109).

When the temperature corresponding to the heater elements H is not lower than the predetermined threshold (NO in ACT 106), the determination unit 630 determines that the sheet has not passed through the positions of the heater elements H (ACT 110). When it is determined that the sheet has not passed through the positions of the heater elements H, the decision unit 640 causes the heater elements H to enter a non-energization state with respect to the sheet, that is, the sheet cassette 141 (ACT 111). Thereafter, the process of ACT 109 is performed.

The image forming apparatus 100 with the foregoing configuration according to an embodiment includes the heater control unit 620 and the decision unit 640. Thus, the sheet to pass and the energization positions are decided based on a change in the temperature corresponding to each heater element H. Then, the decision unit 640 decides the positions of the heater elements H to be energized based on the positions where the sheet passes and the heater control unit 620 causes the heater elements H to be energized. Thus, the controller 600 including a processor can read the energization position information from the storage unit 300 based on an instruction or information of the sheet cassette 141 selected by the user and decides the positions of the heater elements H to be energized corresponding to the transport position of the sheet.

The adjustment according to an embodiment may be performed at a different timing from an actual time of forming an image, and the energization positions may be adjusted at first printing of the actual time of forming an image and control maybe performed at the adjusted energization positions at second and subsequent printing.

MODIFICATION EXAMPLES

The thermistor 502 may be provided one-to-one to the heater element H or may be provided one-to-N (where N is an integer equal to or greater than one) to the plurality of heater elements H.

The acquisition unit 610 may not obtain the temperature of all the thermistors 502 when adjusting the energization positions. That is, the temperature of some of the thermistors 502 may not be obtained using a regular size of a passing sheet as a fixed width. Some of the thermistors are, for example, the thermistors 502 at the positions through which a central portion of the sheet in the main scanning direction passes. The regular size is, for example, a size of a sheet such as A4 or B5 determined in advance.

The heater control unit 620 may control the energization positions of the heater elements H based on the size of the sheet associated with the sheet cassette 141 to be used.

The determination unit 630 may compare values of the thermistors at the positions through which both ends of the sheet pass to values of the thermistors at both ends of the energization position and determine a direction of deviation and a magnitude of deviation. The direction of deviation is a direction of deviation in the main scanning direction between the heater element H at the position where the sheet passes and the heater element H at the energization position. The magnitude of deviation is a difference (for example, a distance) indicating how the heater element H at the position where the sheet passes is distant from the energization position in the main scanning direction. A determination method of adjusting the energization position based on a comparison result will be described with reference to FIG. 10. The description of the content described in FIGS. 4 to 8 will not be repeated.

Figure 10:
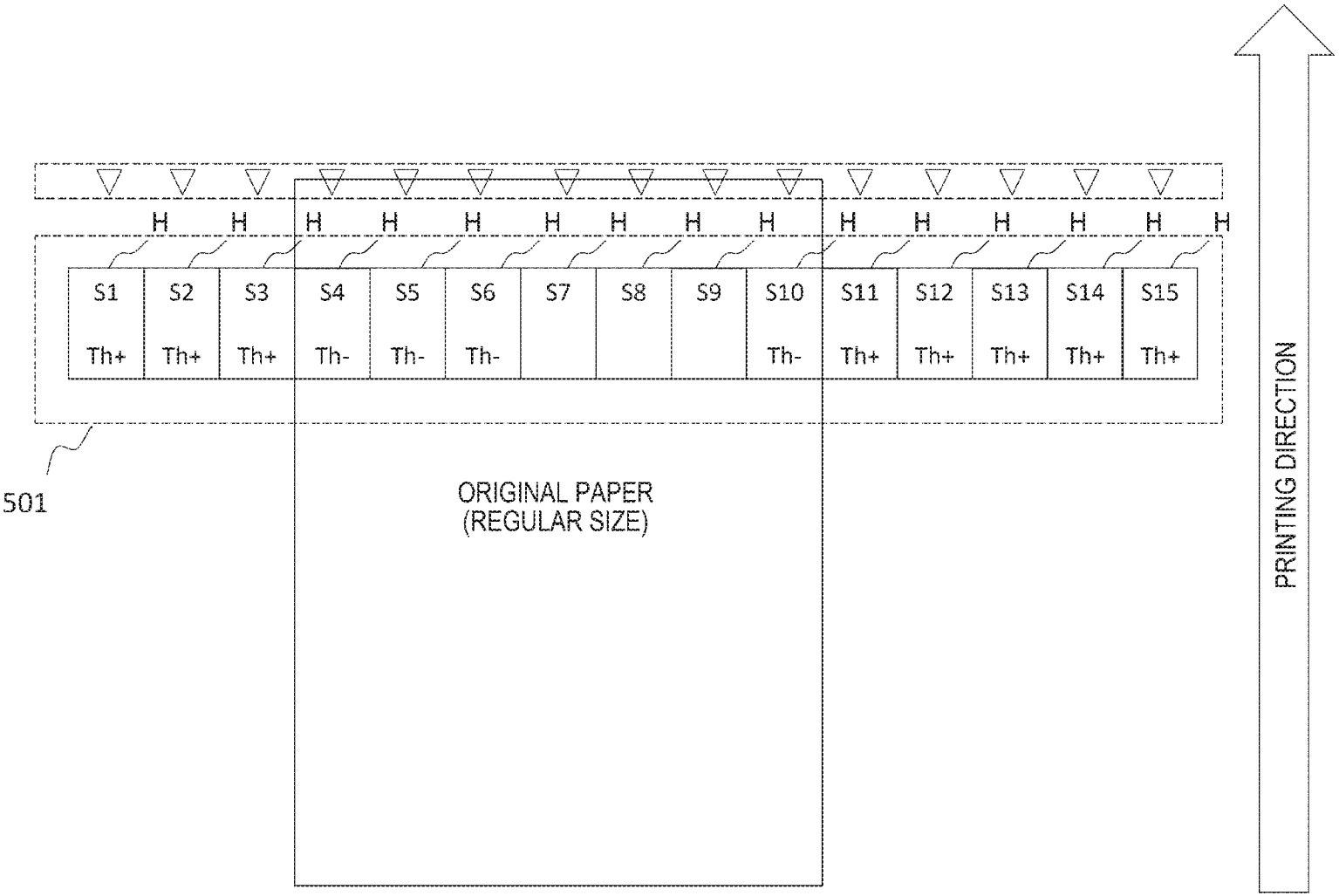
FIG. 10 is a diagram illustrating a temperature change corresponding to each heater element according to one or more embodiments.

FIG. 10 is a diagram illustrating a temperature change corresponding to each heater element H according to one or more embodiments.

In FIG. 10, a sheet transport position and an energization position are decided based on a temperature change when a sheet with a regular size passes through the heater elements H. The acquisition unit 610 obtains temperature information of S1 to S6 and S10 to S15 in the sheet. At this time, the acquisition unit 610 does not obtain temperature information from the thermistors at S7 to S9 which are positions through which the center of the sheet in the main scanning direction passes based on the regular size of the sheet. When the temperature corresponding to the heater elements H is lower than the predetermined threshold, the determination unit 630 determines that the sheet has passed through the positions of these heater elements H. When the temperature corresponding to the heater elements H is not lower than the predetermined threshold, the determination unit 630 determines that the sheet has not passed through the positions of these heater elements H.

In FIG. 10, the spots indicated as Th− are spots where the temperature is lower than the predetermined threshold. The spots indicated as Th+ are spots where a change in the temperature is small or the temperature increases. For example, the determination unit 630 determines that the temperature corresponding to the heater elements H is lower than the predetermined threshold at S4 to S6 and S10. At S1 to S3 and S11 to S15, the determination unit 630 determines that the temperature corresponding to the heater elements H is not lower than the predetermined threshold. Based on the determination result, the decision unit 640 decides S4 to S10 as the energization positions. At this time, the determination unit 630 may measure and determine the temperature of only the thermistors (S4 and S10) through which both ends of the sheet with the regular size pass. The decision 640 may decide the energization positions based on the regular size, the direction of deviation, and the magnitude of deviation.

The storage unit 300 may store the direction of deviation and the magnitude of deviation.

The storage unit 300 may store the sizes of sheets registered by the user as regular sizes in conjunction with the sheet cassettes 141. The storage unit 300 may store the regular sizes of sheets in advance at the time of shipment in conjunction with the sheet cassettes 141. The sheet cassettes 141 may detect the sizes of accommodated sheets and may store the sizes as regular sizes in the storage unit 300.

The determination unit 630 may cause the heater elements H located on the left side of a center portion of all the heater elements H arranged in the main scanning direction to be energized to determine energization positions. The determination unit 630 may cause the heater elements H located on the right side of the center portion of all the heater elements H arranged in the main scanning direction to be energized to determine energization positions. The determination unit 630 may cause the heater elements H located on the left side of a position through a center portion of a sheet passage to be energized and may determine energization positions. The determination unit 630 may cause the heater elements H located on the right side of the position through the center portion of the sheet passage to be energized and may determine energization positions.

The determination unit 630 may cause only a vicinity of only one end of a sheet or only both ends of the sheet to be energized and determine energization positions.

Since a sheet size of a sheet used in an input tray is not regulated in advance, all the heater elements H may be energized when adjusting energization positions and a temperature change may be determined.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a plurality of heater elements arranged in a direction perpendicular to a sheet transport direction to heat the sheet;

a plurality of temperature sensors, each of which is configured to detect a temperature of one of the heater elements; and a controller configured to:

control each of the sensors to detect a first temperature before the sheet is passed by the corresponding heater element and a second temperature of the heater element after the sheet is passed by the corresponding heater element, and determine one or more of the heater elements to be energized based on the first temperatures and the second temperatures detected by the sensors.

2. The image forming apparatus according to claim 1, wherein the controller determines each of the heater elements to be energized when the second temperature thereof is lower than the first temperature of the heater element by a threshold value.

3. The image forming apparatus according to claim 1, wherein the controller is configured to control all of the heater elements to generate heat before the sheet is passed by the heater elements.

4. The image forming apparatus according to claim 3, wherein the controller is configured to determine each of the heater elements to not be energized based on whether the second temperature thereof is equal to or higher than the first temperature of the heater element.

5. The image forming apparatus according to claim 4, wherein when the second temperature of the heater element is equal to or higher than the first temperature, the controller controls the heater element to not be energized when an image is formed on a subsequent sheet.

6. The image forming apparatus according to claim 1, further comprising:

a memory that stores information about a size of the sheet, wherein the controller is configured to control one or more heater elements to generate heat before the sheet is passed based on the size of the sheet.

7. The image forming apparatus according to claim 6, wherein the controller determines the heater elements to be energized based on the first and the second temperatures of each heater element.

8. The image forming apparatus according to claim 6, wherein the controller is configured to detect the size of the sheet based on a sheet cassette being used.

9. The image forming apparatus according to claim 1, wherein the controller is configured to determine the heater elements to be energized when the image forming apparatus receives a printing job and forms a first image on a subsequent sheet.

10. The image forming apparatus according to claim 1, wherein the controller is configured to use the first and the second temperatures detected for one or more heater elements located on a left or a right side of a center in the direction to determine the heater elements to be energized.

11. A method carried out by an image forming apparatus having a plurality of heater elements arranged in a direction perpendicular to a sheet transport direction, the method comprising:

generating heat using one or more of the heater elements;

detecting, using each of a plurality of temperature sensors, a first temperature before a sheet is passed by the corresponding heater element and a second temperature of the heater element after the sheet is passed by the corresponding heater element; and determining one or more of the heater elements to be energized based on the first temperatures and the second temperatures detected by the sensors.

12. The method according to claim 11, wherein each of the heater elements is determined to be energized when a difference between the first and the second temperature of the heater element is larger than a threshold value.

13. The method according to claim 11, wherein all of the heater elements generate heat before the sheet is passed by the heater elements.

14. The method according to claim 13, wherein each of the heater elements is determined to not be energized based on whether the second temperature of the heater element is equal to or higher than the first temperature of the heater element.

15. The method according to claim 14, wherein when the second temperature of the heater element is equal to or higher than the first temperature, the heater element is not energized when an image is formed on a subsequent sheet.

16. The method according to claim 11, wherein one or more heater elements are controlled to generate heat before the sheet is passed based on a size of the sheet.

17. The method according to claim 16, wherein the heater elements are determined to be energized based on the first and the second temperature of each heater element.

18. The method according to claim 16, wherein the size of the sheet is detected based on a sheet cassette being used.

19. The method according to claim 11, wherein the heater elements are determined to be energized when the image forming apparatus receives a printing job and forms a first image on a subsequent sheet.

20. The method according to claim 11, wherein the first and the second temperatures for one or more heater elements located on a left or a right side of a center in the direction are detected.

* * * * *